US005772463A

United States Patent [19]

Kleppe et al.

[11] Patent Number: 5,772,463

[45] Date of Patent: Jun. 30, 1998

[54] ELECTRICAL CABLE WITH IMPROVED CONNECTOR

[75] Inventors: Lawrence Carl Kleppe, Elgin; Rolland Dean O'Groske, Rochester; Glenn Ray Oldenburg, Rochester; Sandra Jeanne Shirk/Heath, Rochester, all of Minn.; Keith Franklin Tharp, San Jose, Calif.; Randall Vincent Tointon, Rochester, Minn.

[73] Assignee: Inernational Business Machines Corporation, Armonk, N.Y.

[21] Appl. No.: 724,812

[22] Filed: Oct. 2, 1996

[51] Int. Cl.[6] ..... H01R 13/64

[52] U.S. Cl. ..... 439/374; 439/910

[58] Field of Search ..... 439/374, 910

[56] References Cited

U.S. PATENT DOCUMENTS 3,904,265 9/1975 Hollyday et al. ..... 339/103 M
4,410,230 10/1983 SanMiguel ..... 339/176 M
5,282,757 2/1994 Maeda ..... 439/374

OTHER PUBLICATIONS

IBM Technical Disclosure Bulletin, "Connector Cover with Bevelled Surfaces for Visual Alignment," Vol. 39, No. 03, p. 279, Mar. 1996.

*Primary Examiner*—Gary F. Paumen
*Attorney, Agent, or Firm*—Andrew J. Dillon

[57] ABSTRACT

A connector is shown for an electrical cable which includes a connector body having oppositely disposed outer walls connected by a pair of oppositely arranged end walls. The outer walls and end walls terminate in a rear wall which together define an enclosure including an internal chamber for receiving an electrical connector element. The oppositely disposed outer walls are provided with bevelled front surfaces which extend from a point co-planar with the remaining outer wall surface inwardly with respect to the internal chamber opening, thereby providing greater visibility of any electrical connector element located within the internal chamber to prevent mis-alignment of connector elements during connection operations.

16 Claims, 3 Drawing Sheets

ELECTRICAL CABLE WITH IMPROVED CONNECTOR

BACKGROUND OF THE INVENTION

1. Technical Field

The present invention relates generally to electrical signal cables of the type used in digital systems and, specifically, to connectors for such cables.

2. Description of the Related Art

A large number of electrical systems, such as systems utilizing digital devices, utilize electrical signal cables of the single and multi-conductor variety. One common digital system, for example, is the digital computer. These systems typically feature a central station housing or body connected by one or more multi-conductor cables to one or more peripheral devices such as printers, modems, external disk drives, CD-ROM devices, computer networks, and the like. The cables which are utilized are typically either round, multi-conductor cables or are flat, ribbon cables. The standard round multi-conductor cable used for these purposes features a plurality of centrally located conductors which are surrounded by, for example, a braided metallic shield layer which, in turn, is surrounded by an outer elastomeric type jacket. The plurality of conductors terminate in electrical leads which are attached at a plurality of points to an electrical connector element which is housed in some sort of connector body. The electrical connector elements have rear faces with contact points to which the electrical leads are attached and have front faces which comprise either male or female interengageable fittings.

The mating male and female fittings of such connector elements typically comprise mating male pins and mating female pin receptacles. Problems exist, at the present time, when users attempt to plug the mating connector elements into position, for example on the rear surfaces of computers or computer peripheral equipment. Since the rear surfaces of such pieces of equipment are often located in difficult to reach or awkward positions, "blind plugging" conditions often exist. Industry standard connector pin configurations make the connectors vulnerable to mis-alignment during connecting operations. As a result, it is often necessary to repair bent pins which result from improper plugging of the cable connectors.

The present invention has as its object to provide an improved electrical signal cable, particularly of the multi-conductor variety, with cable connectors having bevelled front surfaces which visually aid in the alignment of the cable connectors during connecting operations.

Another object of the invention is to eliminate expensive and time consuming repairs associated with bent connector pins which result from improper plugging of cable connectors.

Another object of the invention is to provide such an improved electrical signal cable having cable connectors of a simple design which are economical to manufacture and which can be fabricated from a variety of metal or synthetic plastic type materials.

SUMMARY OF THE INVENTION

A connector is shown for an electrical cable which includes a connector body having a pair of oppositely disposed, generally planar outer walls connected by a pair of oppositely arranged end walls. The generally planar outer walls and end walls terminate in a rear wall which, together with the generally planar outer walls and end walls, form an enclosure including an internal chamber having a chamber opening for receiving an electrical connector element. At least one of the oppositely disposed, generally planar outer walls of the connector body is formed with a bevelled front surface at least partly spanning the distance between the oppositely arranged end walls. The bevelled front surface extends from a point generally co-planar with the remaining planar outer wall inwardly with respect to the internal chamber to the chamber opening, thereby providing greater visibility of an electrical connector element located within the internal chamber to prevent mis-alignment of connector elements during subsequent connection operations.

Preferably, both of the oppositely disposed, generally planar outer walls of the connector body are formed with symmetrically bevelled front surfaces to provide view ports which visually aid in the alignment of the cable connector to a mating connection in use. The connector body can be an insulating body which is fabricated from a variety of metal or plastic type synthetic materials. In the preferred embodiment, the connector body is bisected by a midline which passes laterally through the generally planar outer walls, the bevelled front surfaces beginning at a point between the midline and the chamber opening on the side of the midline opposite the rear wall of the connector. As such, the bevelled front surface constitutes less than about 50% of the planar area of the respective outer wall of the connector body.

The improved electrical signal cable of the invention has a length defined by opposing ends and a longitudinal axis. At least one centrally located conductor runs along the longitudinal axis of the cable between the ends thereof. Preferably, a plurality of centrally located conductors run along the longitudinal axis of the cable between connector bodies located at either end of the cable. An electrical connector element is located within the enclosure of each connector body and has a plurality of contact points on a rear face thereof to which exposed electrical leads of the electrical conductors are attached. The electrical connector element also has a front face which comprises either a male or female electrical fitting. The bevelled front surfaces of the generally planar outer walls of the connector body provide greater visibility of the electrical connector element located within the internal chamber to prevent mis-alignment of the fittings of the connector element during subsequent connection operations.

A digital system is also shown comprising a central station housing, at least one peripheral device and a cable with one of the connector bodies of the invention at each end of the cable for electrically interconnecting the central station housing and the peripheral device. Preferably, the central station housing is a computer housing and the peripheral device is a peripheral computer device.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
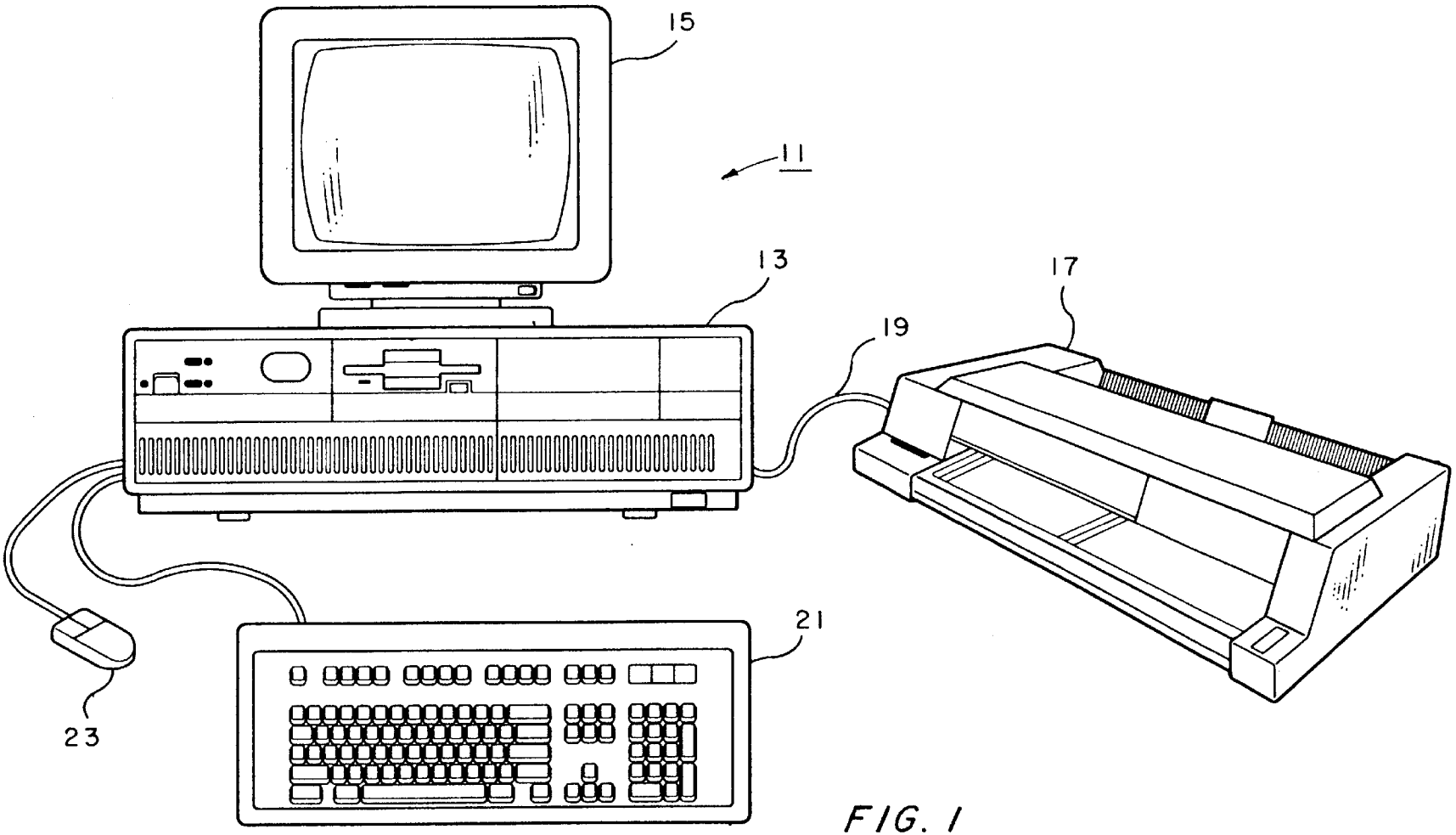
FIG. 1 is a perspective view of a digital system, in this case a personal computer system, employing the improved electrical signal cable of the invention to connect a central station housing to a peripheral device.

FIG. 1 is a view of a typical digital system, in this case a personal computer system, capable of utilizing the improved electrical signal cable of the invention. The digital system 11 in FIG. 1 includes a central station housing 13 which, in this case, is the computer main body containing the principal components of the personal computer such as the microprocessor, power supply, etc. The central station housing 13 can be connected to a variety of peripheral devices such as the monitor 15 and printer 17 by the improved cable 19. The central station housing 13 is also electrically connected to an external keyboard 21 and a pointing device or mouse 23. The improved cable 19 of the invention could be used with any number of peripheral type devices of the kind illustrated, as well as modems, CD-ROMS, DASD devices, tape units, computer networks, etc., depending upon such factors as the type of port and connector fittings utilized.

Figure 2:
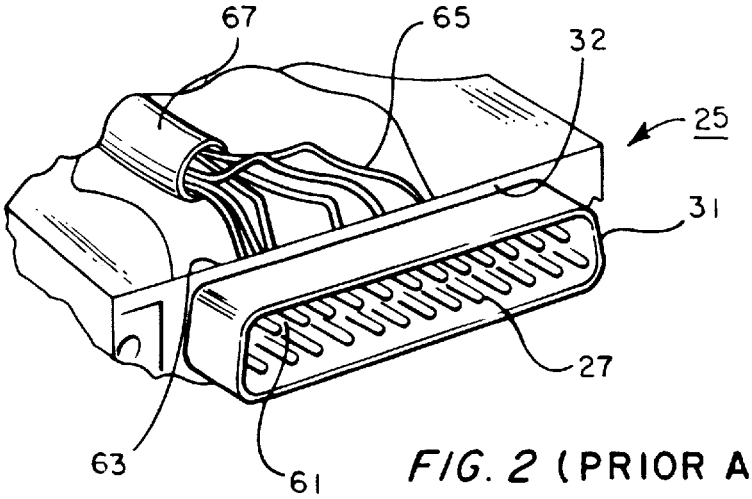
FIG. 2 (PRIOR ART)
FIG. 2 is a partial, perspective view, partly broken away, of a prior art electrical signal cable connector.
Figure 3:
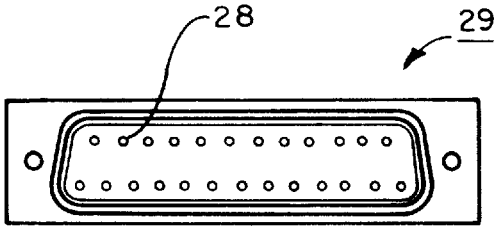
FIG. 3 (PRIOR ART)
FIG. 3 is a front, isolated view of the prior art mating connector for the electrical signal cable connector of FIG. 2.
Figure 4:
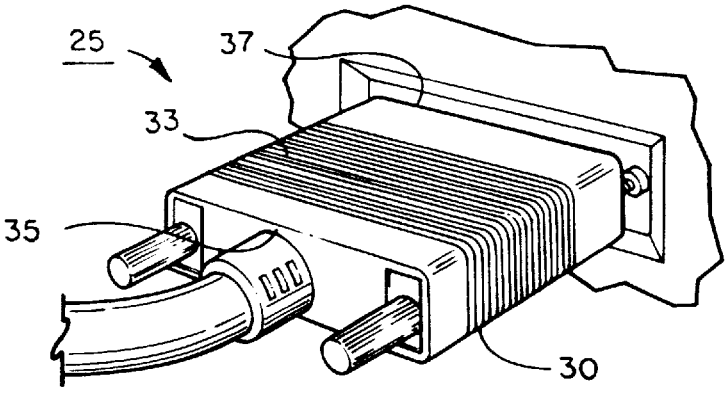
FIG. 4 (PRIOR ART)
FIG. 4 is a rear, perspective view of a prior art electrical signal cable and connector shown in mating engagement with a mating connector, the cable being shown partly broken away.

FIG. 2 shows a prior art connector, partly broken away, designated generally as 25. The connector 25 includes an electrical connector element 31. The connector element 31, in this case, is a male connector element having a plurality of male contact fittings or pins 27 adapted to engage the female fittings 28 of a mating female connector element (29 in FIG. 3). The general type of cable and connector under consideration are referred to in the industry as the SCSI II Cable, described in ANSI Standard X3.1311993. As shown in FIG. 4, the prior art connector included a molded body 30 which includes an internal chamber (32 in FIG. 2) into which the electrical connector element 31 is received.

Because the outer planar walls 33 of the prior art connector were of a generally rectangular configuration and extended from the cable inlet 35 to the chamber opening 37, it was often difficult or impossible to properly align the electrical connector element 31 during connecting operations. This was particularly true where "blind plugging" conditions existed at, for example, the rear surface of the device being plugged. The industry standard con nector pin configuration thus makes the prior art connector vulnerable to mis-alignment during installation. As a result, field repairs were often necessary to repair bent pins due to improper plugging of the connectors.

Figure 5:
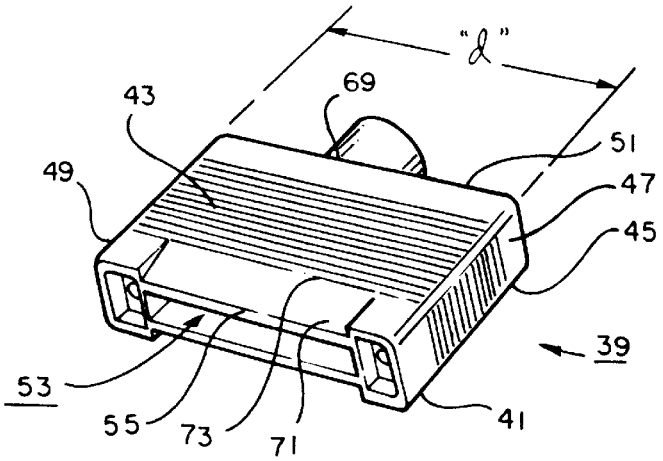
FIG. 5 is an isolated, perspective view of the improved cable connector of the invention.
Figure 6:
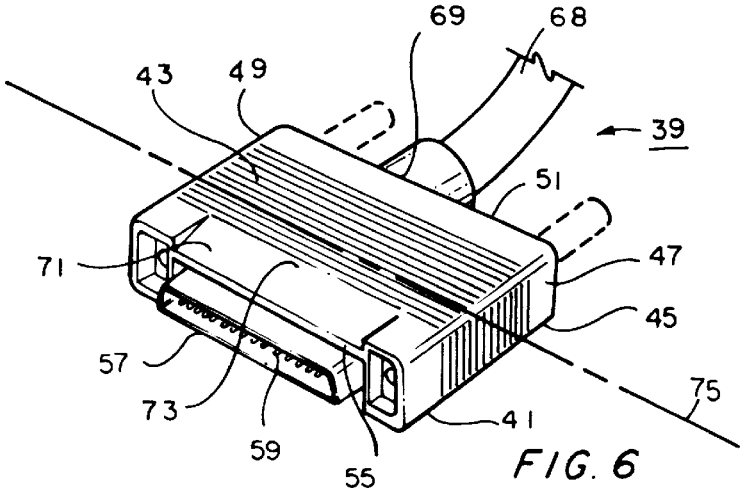
FIG. 6 is a perspective view of the improved connector with the associated cable and connector elements installed.
Figure 7:
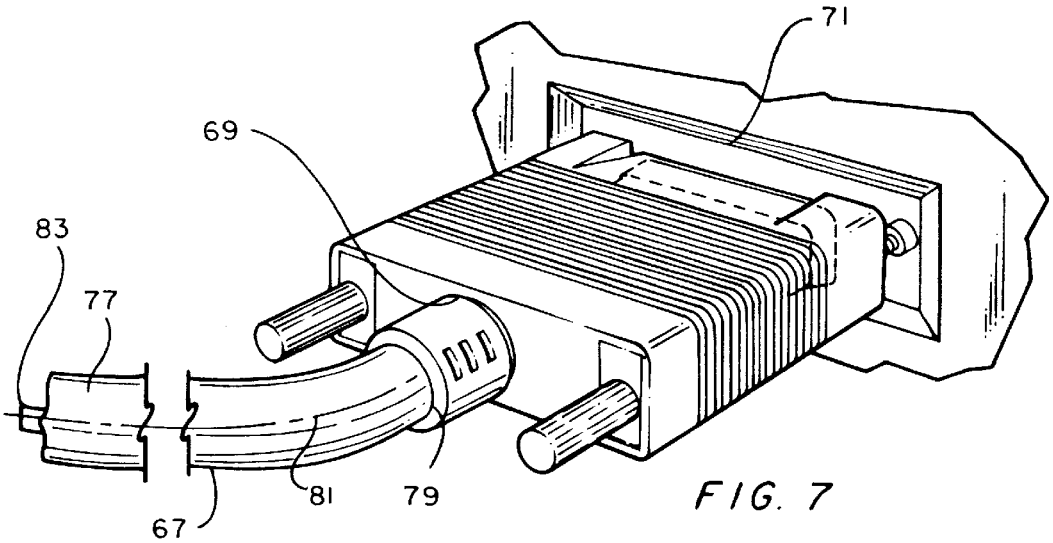
FIG. 7 is a rear, perspective view of the electrical signal cable and connector of the invention shown in mating engagement with a mating connector, the cable being shown partly broken away.

FIGS. 5–7 show the improved connector of the invention, designated generally as 39. The connector 39 includes a connector body 41 having a pair of oppositely disposed, generally planar outer walls 43, 45 connected by a pair of oppositely arranged end walls 47, 49. The generally planar outer walls 43, 45 terminate in a rear wall 51 which, together with the generally planar outer walls and end walls, forms an enclosure including an internal chamber 53 having a chamber opening 55 for receiving an electrical connector element. The view of the connector 39 in FIG. 5 does not include the associated cable or electrical connector element, but merely shows the connector body in isolated fashion.

As shown in FIG. 7, the cable 67 ha s a length defined by opposing ends 77, 79 and a longitudinal axis 81. At least one centrally located conductor 83, and preferably a plurality of conductors, runs along the longitudinal axis 81 of the cable between the ends 77, 79 thereof.

As best seen in FIG. 6, the connector will, in use, include an electrical connector element 57, such as an SCSI industry standard connector which, in this case, is a male connector element having a standard pin fitting configuration. In the same manner as the prior art connection 25 (FIG. 2), the pins 59 on the front face of the male connector element (see face 61 in FIG. 2) are electrically connected on a rear face (see face 63 in FIG. 2) to a plurality of exposed electrical leads 65 of the electrical cable 67 (FIG. 2). The cable 68, in this case (FIG. 6), is a round, multi-conductor shielded cable of the type typically used for external applications where electromagnetic compatibility and electrostatic discharge protection may be required. However a non-shielded cable might also be used in certain applications. Also, even though a round, multi-conductor type cable 68 is shown in the preferred embodiment, other cable configurations could be utilized, as well, such as flat ribbon cable, and the like. In such cases, it is only necessary that the cable inlet point 69 be properly configured to accept the particular cable configuration utilized.

As best seen in FIG. 6, the improved connector 39 of the invention has at least one of the oppositely disposed, generally planar outer walls 43, 45 formed with a bevelled front surface 71 at least partly spanning the distance ("d" in FIG. 5) between the oppositely arranged end walls 47, 49. The bevelled front surface 71 extends from a point 73 generally co-planar with the remaining planar outer wall 43 inwardly with respect to the internal chamber 53 (FIG. 5) to the chamber opening 55, thereby providing greater visibility of any electrical connector element located within the internal chamber 53 to prevent mis-alignment of connector elements during subsequent connection operations.

Preferably, both of the oppositely disposed, generally planar outer walls 43, 45 of the connector body 41 are formed with the bevelled front surfaces 71, the bevels being oppositely arranged so that each bevelled front surface is tapered inwardly in the direction of the internal chamber opening 55. The connector body 41, as shown in FIG. 6, can be bisected by a midline 75 which passes laterally through the generally planar outer wall 43. The bevelled front surface 71 begins at a point 73 which is located between the midline 75 and the chamber opening 55 on the side of the midline opposite the rear wall 51 of the connector 39. Although the bevelled front surfaces 71 are shown as being symmetrical, they need not necessarily be so.

The connector body 41 can conveniently be provided as an insulating body which is molded from a synthetic plastic type material. For example, the body 41 can be injection molded with a cable inlet opening, allowing the cable to be inserted through the opening with the exposed leads then being attached to the connector element and the element then being pulled through the chamber opening 55 to be properly installed within the internal chamber. The connector body could also be fabricated of other materials, including metals and could be provided in mirror image halves which are placed together to form the desired shape illustrated, the halves being connected by screw fittings, or the like. The preferred body 41, shown in FIGS. 5–7 of the drawings, is injection molded of a suitable plastic for reasons of simplicity and economy.

As seen by referring to the prior art connection in FIG. 4 and by then referring to the improved connection in FIG. 7, the bevelled front surfaces 71 provide greater visibility for properly locating and orienting the connector elements during connecting operations.

An invention has been provided with several advantages, the improved connector of the invention provides a "view-port" which allows visual alignment of the electrical connector elements when plugging the connector into an electrical device. The angled front surfaces of the connector are symmetrical and allow for viewing from either side of the connector during the plugging operation. The visual alignment allowed by the bevelled front surfaces of the connector reduce bent pin problems in the field that have long existed with the industry standard SCSI interface. These same problems have also existed, in the past, with other styles of molded "D-Shell" connector systems. The connector of the invention is simple in design and economical to manufacture and can be easily injection molded from a suitable plastic, or fabricated from metal. Existing tooling for the prior art connectors can be economically updated to incorporate the "view-port" feature of the present invention.

While the invention has been particularly shown and described with reference to a preferred embodiment, it will be understood by those skilled in the art that various changes in form and detail may be made therein without departing from the spirit and scope of the invention.

What is claimed is:

1. A connector for an electrical cable, comprising:

a connector body having a pair of oppositely disposed, generally planar outer walls connected by a pair of oppositely arranged end walls, the generally planar outer walls and end walls terminating in a rear wall which, together with the generally planar outer walls and end walls, form an enclosure including an internal chamber having a chamber opening for receiving an electrical connector element;

wherein at least one of the oppositely disposed, generally planar outer walls of the connector body is formed with a bevelled front surface at least partly spanning the distance between the oppositely arranged end walls, and wherein the bevelled front surface extends from a point generally co-planar with the remaining planar outer wall inwardly with respect to the internal chamber to the chamber opening, thereby providing greater visibility of any electrical connector element located within the internal chamber to prevent misalignment of connector elements during subsequent connection operations.

2. The connector of claim 1, wherein both of the oppositely disposed, generally planar outer walls of the connector body are formed with a said bevelled front surface.

3. The connector of claim 2, wherein the connector body can be bisected by a midline passing laterally through the generally planar outer walls, the bevelled front surfaces beginning at a point between the midline and the chamber opening on the side of the midline opposite the rear wall of the connector.

4. The connector of claim 1, wherein the connector body is an insulating body which is molded from a synthetic plastic type material.

5. The connector of claim 1, wherein the connector body is fabricated from metal.

6. An improved electrical signal cable having a length defined by opposing ends and a longitudinal axis, the improved cable comprising:

at least one centrally located conductor running along the longitudinal axis of the cable between the ends thereof;

a connector body located at least one end of the centrally located conductor, the connector body having a pair of oppositely disposed, generally planar outer walls connected by a pair of oppositely arranged end walls, the generally planar outer walls and end walls terminating in a rear wall which, together with the generally planar outer walls and end walls, form an enclosure including an internal chamber having a chamber opening which receives an electrical connector element which is connected to the centrally located conductor;

wherein at least one of the oppositely disposed, generally planar outer walls of the connector body is formed with a bevelled front surface at least partly spanning the distance between the oppositely arranged end walls, and wherein the bevelled front surface extends from a point generally co-planar with the remaining planar outer wall inwardly with respect to the internal chamber to the chamber opening, thereby providing greater visibility of the electrical connector element located within the internal chamber to prevent misalignment of connector element during subsequent connection operations.

7. An improved multi-conductor signal cable having a length defined by opposing ends and a longitudinal axis, the improved cable comprising:

a plurality of centrally located conductors running along the longitudinal axis of the cable between the ends thereof;

a connector body located at each of the ends of the centrally located conductors, each of the connector bodies having a pair of oppositely disposed, generally planar outer walls connected by a pair of oppositely arranged end walls, the generally planar outer walls and end walls terminating in a rear wall which, together with the generally planar outer walls and end walls, form an enclosure including an internal chamber having a chamber opening which receives an electrical connector element which is connected to the centrally located conductors;

wherein at least one of the oppositely disposed, generally planar outer walls of each connector body is formed with a bevelled front surface at least partly spanning the distance between the oppositely arranged end walls, and wherein the bevelled front surface extends from a point generally co-planar with the remaining planar outer wall inwardly with respect to the internal chamber to the chamber opening, thereby providing greater visibility of the electrical connector element located within the internal chamber to prevent misalignment of connector element during subsequent connection operations.

8. The cable of claim 7, wherein each of the connector bodies can be bisected by a midline passing laterally through the generally planar outer walls, the bevelled front surfaces beginning at a point between the midline and the chamber opening on the side of the midline opposite the rear wall of the connector.

9. The cable of claim 7, wherein each of the connector bodies is an insulating body which is molded from a synthetic plastic type material.

10. The cable of claim 7, wherein each of the connector bodies is fabricated from metal.

11. A digital system, comprising:

a central station housing;

at least one peripheral device;

a cable having a length defined between opposing ends and having a central longitudinal axis;

a connector body at each end of the cable for electrically interconnecting the central station housing and the peripheral device;

a plurality of electrical conductors running along the longitudinal axis of the cable and terminating in exposed electrical leads;

a connector body located at each of the ends of the centrally located conductors, each of the connector bodies having a pair of oppositely disposed, generally planar outer walls connected by a pair of oppositely arranged end walls, the generally planar outer walls and end walls terminating in a rear wall which, together with the generally planar outer walls and end walls, form an enclosure including an internal chamber having a chamber opening which receives an electrical connector element having a plurality of contact points on a rear face thereof to which the exposed electrical leads of the electrical conductors are attached and having a front face;

wherein at least one of the oppositely disposed, generally planar outer walls of each connector body is formed with a bevelled front surface at least partly spanning the distance between the oppositely arranged end walls, and wherein the bevelled front surface extends from a point generally co-planar with the remaining planar outer wall inwardly with respect to the internal chamber to the chamber opening, thereby providing greater visibility of the electrical connector element located within the internal chamber to prevent misalignment of connector element during subsequent connection operations.

12. The digital system of claim 11, wherein the central station housing is a computer housing and the peripheral device is a peripheral computer device.

13. The digital system of claim 11, wherein both of the oppositely disposed, generally planar outer walls of the connector bodies are formed with a said bevelled front surface.

14. The digital system of claim 13, wherein each connector body can be bisected by a midline passing laterally through the generally planar outer walls, the bevelled front surfaces beginning at a point between the midline and the chamber opening on the side of the midline opposite the rear wall of the connector.

15. The digital system of claim 11, wherein each connector body is an insulating body which is molded from a synthetic plastic type material.

16. The digital system of claim 11, wherein each connector body is fabricated from metal.

* * * * *